US006799384B1

(12) United States Patent
Grandin et al.

(10) Patent No.: US 6,799,384 B1
(45) Date of Patent: Oct. 5, 2004

(54) SPORTS SHOE WITH LEG-PIECE HINGED ON THE SHELL

(75) Inventors: Giorgio Grandin, Treviso (IT); Pierluigi Lorati, Brescia (IT); Daniele Vanin, Treviso (IT)

(73) Assignee: Tecnica SPA, Treviso (IT)

( * ) Notice: Subject to any disclaimer, the term of this patent is extended or adjusted under 35 U.S.C. 154(b) by 0 days.

(21) Appl. No.: 10/333,986

(22) PCT Filed: Sep. 1, 2000

(86) PCT No.: PCT/IT00/00351

§ 371 (c)(1),
(2), (4) Date: Jan. 27, 2003

(87) PCT Pub. No.: WO02/17741

PCT Pub. Date: Mar. 7, 2002

(51) Int. Cl.[7] ..... A43B 5/04
(52) U.S. Cl. ..... 36/118.7; 36/118.2
(58) Field of Search ..... 36/118.2, 118.7, 36/118.8

(56) References Cited

U.S. PATENT DOCUMENTS 4,085,528 A * 4/1978 Delery ..... 36/119.1
4,334,368 A * 6/1982 Chalmers et al. ..... 36/118.7
4,539,764 A * 9/1985 Pradier ..... 36/118.7
4,601,118 A 7/1986 Zanatta
4,615,128 A * 10/1986 Borsoi ..... 36/118.7
4,916,835 A 4/1990 Begey et al.
5,363,572 A * 11/1994 Marega et al. ..... 36/118.7
5,675,917 A * 10/1997 Falguere et al. ..... 36/117.2

FOREIGN PATENT DOCUMENTS

EP 171384 * 7/1987
EP 0 775 454 A 5/1997
FR 2433311 A 3/1980

* cited by examiner

*Primary Examiner*—Ted Kavanaugh
(74) *Attorney, Agent, or Firm*—Birch, Stewart, Kolasch & Birch, LLP

(57) ABSTRACT

Sports shoe having a shell (10) partially overlapped by a leg-piece (20) and adjusting hinge (52, 53) for allowing a flexing movement of controlled amplitude of the leg-piece about a hinging axis. In the overlapping zones (ZE, ZI) plates (42, 41; 47) provided on the outer surfaces of the leg-piece (20) allow selective insertion and subsequent locking of at least one hinge (52, 53) in any one of the matching seats (33, 34, 35, 36; 37; 34', 36') provided on the shell (10). The hinging axis thus able to assume at least two different angular positions (X1, X2, X3, X4) relative to the longitudinal centre plane (M) of the shoe, as required by the user.

8 Claims, 3 Drawing Sheets

SPORTS SHOE WITH LEG-PIECE HINGED ON THE SHELL

This application is the national phase under 35 U.S.C. §371 of PCT International Application No. PCT/IT00/00351 which has an International filing date of Sep. 1, 2000, which designated the United States of America.

TECHNICAL FIELD

The invention relates to a sports shoe, e.g. a shoe used for roller skating or a ski boot, in which there is a system for hinging the leg-piece on the shell.

BACKGROUND ART

Very briefly—as illustrated, for example, in EP-A-0,502,795 and EP-A-0,671,134—a shoe of this kind comprises two main components which are made from injection-moulded polymer materials, i.e.:

- a shell with a more rigid part and a front longitudinal slit for inserting the foot, which defines two softer front portions, and
- a deformable leg-piece which is often formed by a front part and a rear part and is hinged on the shell about a transverse axis which is located more or less level with the user's malleoli.

In material terms, the hinging system consists of a pair of rivets arranged in a zone on the inner side and in a zone on the outer side where the leg-piece is arranged overlapping the shell and allows an angular (flexing) movement of the leg-piece in the lengthwise direction of the shoe.

BACKGROUND ART

Shoes provided with devices which allow the user to adjust the amplitude of the said flexing movement are known—see for example FR-A-2,682,859.

This possibility of adjustment is undoubtedly advantageous in the case where it is required to change from a sporty skiing posture to a more relaxed posture and/or when there is a change in the location (on-piste or off-piste) and/or snow conditions (compacted snow or fresh snow), but is of no help for persons whose legs have an anatomical form different from the so-called normal form.

Bowed legs or legs which form an "X" rather than a "Y", when viewed frontally, may in fact result in frequent and important manoeuvres such as "edging" of the skis and skates being tiring, if not difficult, to perform, but the present footwear is unable to remedy these situations.

The following documents are also worth mentioning as representative of the state of art:

U.S. Pat. No. 4,916,835, where the leg-piece (shaft) of a ski boot is connected to the shell by means of a couple of hinging means aligned along a transverse axis and connected to one another by a stirrup in the form of a flexible strip. The said hinging means are fixed with respect to the leg-piece but can be shifted in a substantially vertical direction in relation to the shell.

U.S. Pat. No. 4,601,118, where a block connected to the leg-piece (boot leg) and a block connected to the shell (boot body) have a common pin which, in cooperation with a spring washer, permits a vertical displacement of boot leg with respect to the boot body and the side inclination of boot leg to be adjusted with respect to the boot body. In this manner the boot is adaptable to the morphology of the lower limbs so that a skier is enabled to forwardly bring the tibiae toward the tip of the boot. In other words, an angular adjustment is enabled in a substantially vertical plane wich is parallel to the longitudinal mid plane of the boot.

EP-A-0 775 454, where the hinge connecting the leg-piece to the shell of a ski boot can be displaced in a vertical direction so as to again enable an angular adjustment of the leg-piece in a substantially vertical plane wich is parallel to the longitudinal mid plane of the boot.

FR-A-2 433 311, where the transversal hinging axis between the leg-piece and the shell is mounted in such a way to be rotatable about a longitudinal axis.

DISCLOSURE OF THE INVENTION

The main object of the invention is to propose a sports shoe in which the system for hinging the leg-piece on the shell may be adjusted so as to take into account also the actual morphology of the users' legs, so that the fatigue arising during the various manoeuvres required by the sporting discipline, in the case of anatomically abnormal legs, is reduced significantly, if not eliminated.

According to the main characteristic feature of the invention, these and other objects are obtained by providing a sports shoe of this kind with means which allow adjustment of the angle formed by the transverse hinging axis of the leg-piece on the shell with the longitudinal centre plane of the shoe.

BRIEF DESCRIPTION OF THE DRAWINGS

By way of a non-limiting example, in order to illustrate more clearly the characteristic features and advantages of the invention, an application thereof will now be described with reference to the accompanying drawing in which (excluding many details which are well-known to persons skilled in the art but which are of no importance for the subject of the invention).

DETAILED DESCRIPTION OF THE PREFERRED EMBODIMENT(S)

Figure 1:
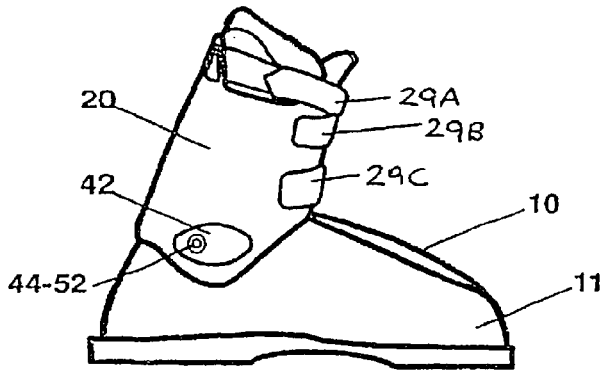
FIG. 1 shows a simplified profile view of a ski boot.
Figure 2:
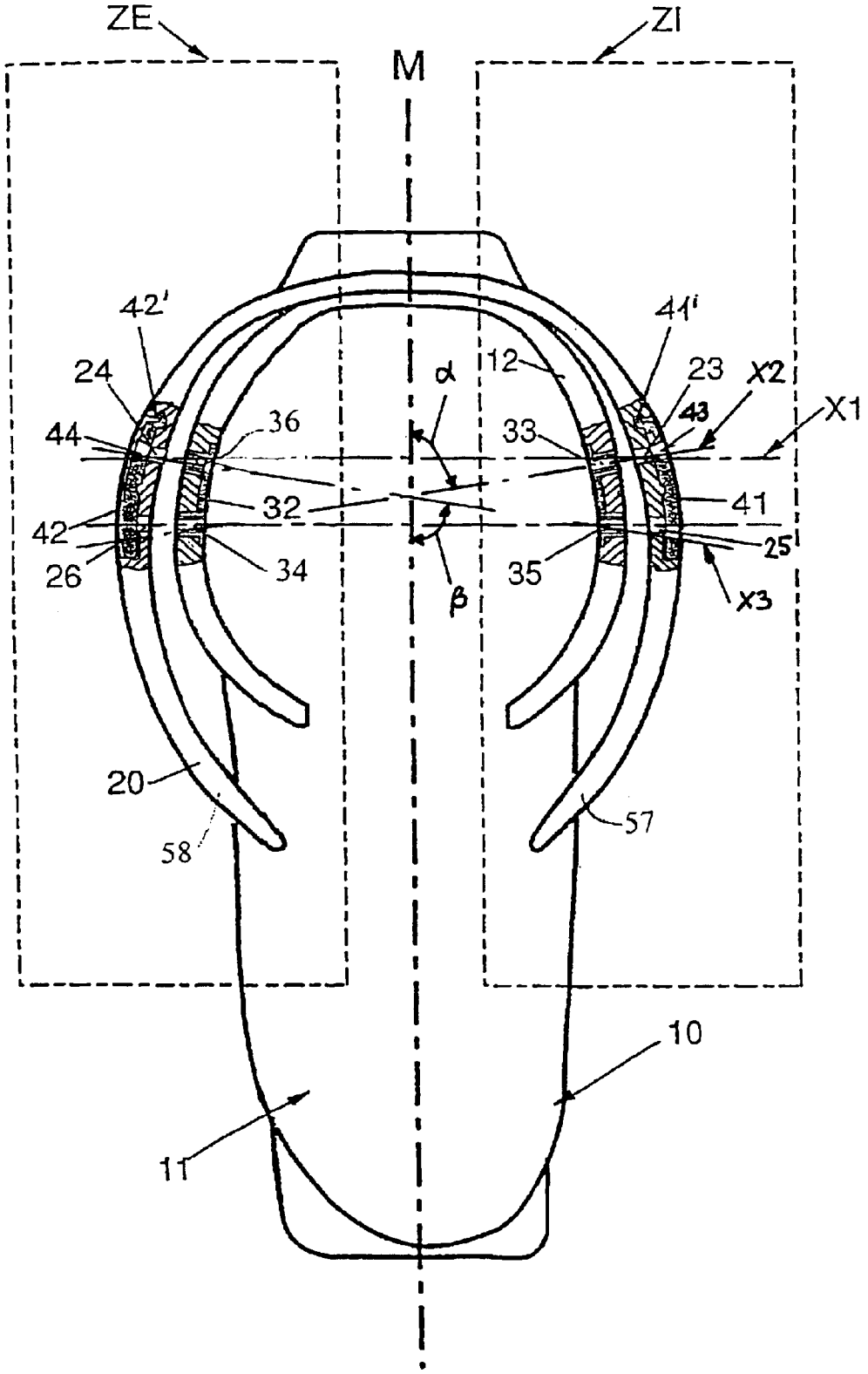
FIG. 2 is another simplified view which shows the same boot viewed from above and partially sectioned along a horizontal plane perpendicular to the longitudinal centre plane so as to highlight a first embodiment of the means for hinging the shell and leg-piece.

FIGS. 1 and 2 show, albeit in simplified form, the shell 10 and the leg-piece 20 which, according to the terminology used here, are the main components of a ski boot. The shell 10 comprises a first horizontal part 11 for receiving the user's foot and a second part 12 which extends upwards, for retaining the heel, while the leg-piece 20 comprises two cheeks 27, 28 provided with well-known fastening devices and closing strips 29A, 29B and 29C. The leg-piece 20 is arranged overlapping the part 12 of the shell 10 and hinged thereon, using the means described below, in a zone ZE on the outer side and of a zone ZI on the inner side, where the terms "outer" and "inner" are relative to the longitudinal centre plane M of the shoe.

Figure 3:
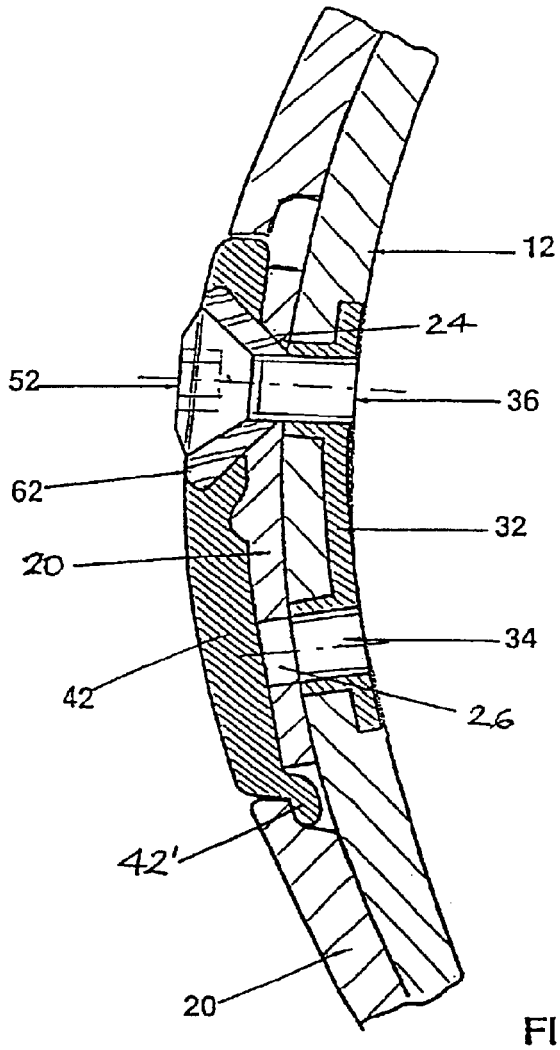
FIG. 3 shows, on a larger scale, a few details of the part shown in cross-section in FIG. 2.

According to a first embodiment, shown in FIGS. 2 and 3, the system for hinging the leg-piece 20 on the shell 10 comprises:

- a first proximal plate 32 and a first distal plate 42 which are arranged behind one another in the zone ZE. The proximal plate 32 is rigidly retained (e.g. by means of over-injection of polymer material) on the inner surface of the part 12 of the shell 10 and provided with two threaded holes 34 and 36 which pass through the whole thickness of the shell 10. The distal plate 42 is retained by means of an undercut 42', with a certain backlash allowing manipulation thereof, inside a recess on the visible surface of the leg-piece 20 having two through-holes 24 and 26. The distal plate 42 has a single through-hole 44 which is flared towards the outside of the shoe and aligned with the hole 24 of the leg-piece 20 in the arrangement shown in FIGS. 2 and 3;
- a second proximal plate 31 and a second distal plate 41 which are respectively identical to the plates 32 and 42 in the zone ZI. The proximal plate 31 is rigidly retained (e.g. by means of over-injection of the polymer material) on the inner surface of the part 12 of the shell 10 and has two threaded holes 33 and 35 which pass through the whole thickness of the shell 10. The distal plate 41 is retained by means of an undercut 41', with a certain backlash allowing manipulation thereof, inside a recess on the visible surface of the leg-piece 20 having two through-holes 23 and 25. The distal plate 41 has a single through-hole 43 which is flared towards the outside of the shoe and aligned with the hole 23 of the leg-piece 20 in the arrangement shown in FIG. 2;
- as actual adjustable-hinging means, a pair of flathead screws (only one of which, indicated by the reference number 52, is shown in FIGS. 1 and 3) with the same threading as that of the holes 33, 35 and 34, 36 in the proximal plates 31 and 32;
- a pair of conical bushes preventing unscrewing, only one of which, indicated by the reference number 62, is shown in FIG. 3.

The boot is usually supplied by the manufacturer with the above-described arrangement of the distal plates 41, 42 (referred to in short as "insertion means" in the claims below). In the zone ZE the screw 52, which is locked by the bush 62, passes through the holes 44 in the first distal plate 42 and 24 of the leg-piece 20 and engages in the first threaded hole 36 of the first proximal plate 32—see FIG. 3—while in the zone ZI the other screw (not shown) passes through the holes 43 in the second distal plate 41 and 23 of the leg-piece 20 and engages inside the first threaded hole 33 of the second proximal plate 31. In this way the two screws are aligned, in accordance with an arrangement, indicated by X1 in FIG. 2, which joins together the centres of the threaded holes 33 and 34 and defines the hinging axis of the leg-piece 20 on the shell 10. Thus, in the configuration supplied by the manufacturer, the boot allows relatively soft and yielding flexing movements of the leg-piece 20 on the shell 10 in the lengthwise direction of the boot since the arrangement X1 of the hinging axis is set back and moreover configured for users who have. anatomically normal—i.e. straight—legs, the arrangement X1 being also perpendicular to the longitudinal centre plane M.

Owing to the invention, however, it is also possible to obtain other arrangements of the hinging axis of the leg-piece 20 on the shell 10, which may be conveniently and easily adjusted as follows at the time of sale of the boot.

If the user's knees are rotated outwards, the only operations required are performed in the outer overlapping zone ZE and consist in the removal of the screw 52 together with the bush 62, rotation of the first distal plate 42 through 180° in its plane (so that the undercut 42' is located on the opposite side to that shown in FIG. 3) and re-insertion of the screw 52 together with the bush 62 into the through-hole 44 of the said distal plate 42 so that, after passing through the hole 26 in the leg-piece 20, it thus engages inside the second threaded hole 34 of the proximal plate 32. The axes of the two screws are thus aligned in an arrangement X2 which, joining together the centers of the threaded holes 36 and 33, defines again the hinging axis of the leg-piece 20 on the shell 10. The arrangement X2 has an inclination a relative to the longitudinal center plane M and produces a second configuration of the boot which, obviously, opposes the natural tendency of the said leg morphology to spread the tip of the skis.

If, on the other hand, the user's knees are rotated inwards, the only operations required in order to modify the configuration of the boot (again with respect to the configuration in which it is supplied by the boot manufacturer—shown in FIGS. 2 and 3) are performed in the internal overlapping zone and correspond to those just described. The screw together with the associated bush it in fact removed from the distal plate 41, which is then rotated through 180° in its plane. The screw together with the bush is finally re-inserted into the hole 43 of the plate 41 so that, after passing through the second hole 25 in the leg-piece 20, it engages into the second threaded hole 35 of the proximal plate 31. The axis for hinging the leg-piece 20 on the shell 10, which now joins together the centers of the threaded holes 36 and 35, thus assumes an arrangement X3 with an inclination $\beta$ which produces a third configuration of the boot. Since the inclination $\beta$ is opposite to the inclination $\alpha$ relative to the longitudinal center plane M, this third configuration of the boot obviously opposes the natural tendency of persons who have the abovementioned anatomical morphology of their legs to move the tips of their skis towards each other.

The invention also offers a further possibility of adjusting hinging of the leg-piece on the shell, by carrying out both the sequences of operations described above. In this way, the hinging axis of the leg-piece 20 on the shell 10, which now joins together the centres of the threaded holes 34 and 35, assumes an arrangement which is indicated in FIG. 2 by X4 and is perpendicular to the longitudinal centre plane M, but located in a relatively advanced position on the boot. This arrangement of the hinging axis results in a configuration of the boot which is particular suitable for users who have anatomically normal legs and prefer relatively rigid flexing of the leg-piece.

Figure 4:
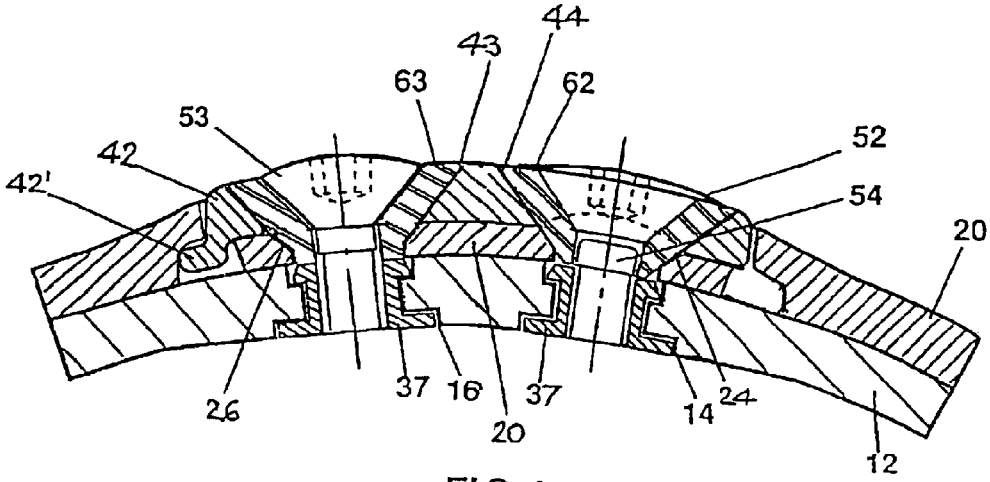
FIG. 4 is similar to FIG. 3, but shows a second embodiment of the said hinging means.

A second embodiment of the invention is shown in FIG. 4 where, for the sake of simplicity, the parts which are unvaried with respect to the first embodiment, described hereinabove, retain the same reference numbers. For example, in the outer overlapping zone ZE, each of the proximal plates 31, 32 are now replaced by two flanged and threaded cylindrical bushes 37 which pass through the entire thickness of the part 12 of the shell 10 and are retained on the said part 12. Moreover, the distal plate 42 and the underlying recess of the leg piece 20 inside which it is housed have two aligned through-holes instead of only one, indicated respectively by the reference numbers 44, 46 and 24, 26. FIG. 4 shows, together with the associated conical bushes 62 and 63 preventing unscrewing, two screws 52 and 53 which engage in each of the bushes 37 so as to lock entirely (if the user so wishes) hinging of the leg-piece 20 on the shell 10. In other words, in this embodiment of the invention the boot may assume a fifth configuration. In order to obtain the other four configurations described further above it is sufficient to use only one screw in each of the zones ZE and ZI and close the hole which is not used with a stopper 54, preferably supplied by the manufacturer, in order to prevent snow entering inside the boot. From the point of view of practical use, a further advantage offered by this second embodiment consists in the fact that it is not necessary to rotate the distal plates in their planes in order to change from one configuration of the boot to another.

Figure 5:
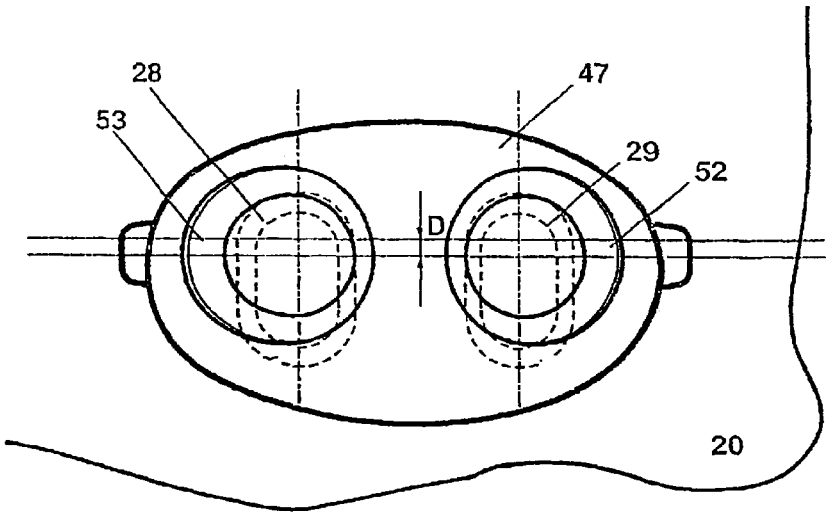
FIG. 5 shows a partial profile view, on a larger scale, of a shoe provided with a third embodiment of the said hinging means.

A third embodiment of the invention differs from the preceding embodiment in that it envisages, in the zones ZE and ZI, distal plates, such as that indicated in FIG. 5 by the reference number 47, as means for inserting the screws 52 and/or 53 which form the actual adjustable hinging means for the leg-piece 20 on the shell 10. The plate 47 has two through-holes 44, 46 which are associated with vertically elongated eyelets 28 and 29 provided on the leg-piece 20 in the recess inside which said plate is housed. Consequently, in addition to the five configurations of the second embodiment, in this way it is also possible to displace vertically the hinging axis of the leg-piece 20 on the shell 10 (always coinciding with the centres of the threaded holes 34, 36 or 37 on the part 12 of the shell 10 inside which the screws engage). The amount of this possible displacement in the vertical direction corresponds to the eccentricity D of the elongated eyelets 28 and 29. This third embodiment of the invention therefore offers the further advantage that the said means used for adjusting hinging of the leg-piece on the shell also allow adjustment of the so-called "canting" of the boot.

Figure 6:
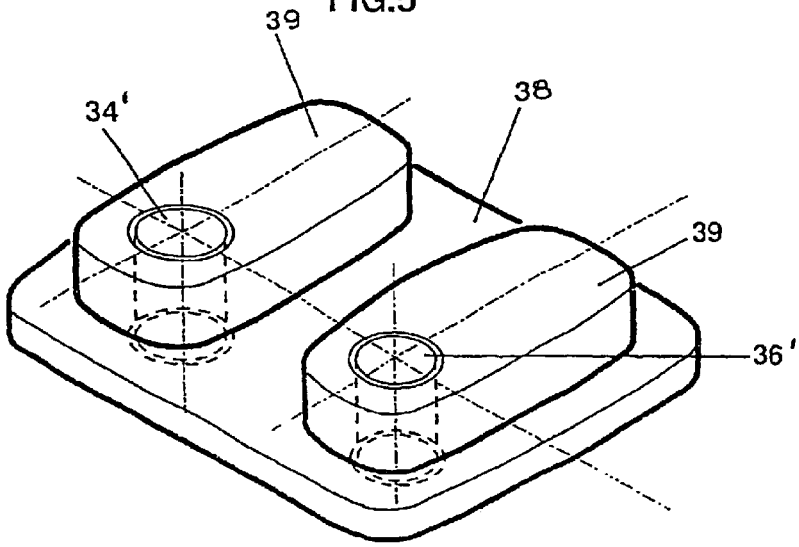
FIG. 6 shows a three-dimensional view, on a larger scale, of a detail of a fourth embodiment of the said hinging means.

A fourth embodiment of the invention, which also allows the "canting" of the shoe to be adjusted without the addition of special-purpose means, in turn envisages the use of proximal plates such as that indicated by the reference number 38 in FIG. 6 and having, on the side directed towards the leg-piece, two lugs 39 with respective threaded holes 34' and 36' designed to engage with screws (not shown) which in this case also are inserted via the holes in the associated distal plates.

From the above description it emerges that the main advantage of the invention consists in an adjustment which hitherto has not been possible for shoes of the type considered here, it being possible to perform said adjustment in a permanent manner at the time of purchase and with the aid of a basic tool such as a screwdriver. The means which allow transition from one configuration of the shoe to another are, in turn, very simple, entirely compatible with the current technology used for manufacture of this footwear and do not increase significantly the industrial cost of the latter.

In addition to those described hereinabove, other variations and embodiments of the invention may obviously be developed within the scope of protection of the following claims, such as:

proximal plates which have a more or less round shape owing to the presence of more than two threaded holes, so as to increase the possible arrangements of the axis of rotation of the leg-piece on the shell, if necessary also in planes inclined relative to the longitudinal centre axis of the shoe. By way of a variant it will obviously be possible to use a number of flanged and threaded bushes fixed to the inner surface of the shell, greater than two;

distal plates slidable horizontally on the outer surface of the leg-piece so as to change from one angular arrangement of the hinging axis to another, relative to the longitudinal centre plane M of the shoe;

use of hinging means other than screws with a flat flared head, for example conical pins or the like.

What is claimed is:

1. Sports shoe, a part which extends upwards of a shell at a zone on the inner side and a zone on the outer side relative to a longitudinal center plane;

adjustable hinging means for joining the leg piece to said outwardly extending part of the shell, which define an axis about which the leg-piece is able to perform a flexing movement of controlled amplitude along the center plane, a pair of spaced apart apertures on said upwardly extending part of the shell at each of said inner and outer zones; and plates on corresponding outer surfaces of the leg piece for allowing selective insertion and subsequent locking of at least one of the hinging means, so that, the said hinging axis may assume at least two different angular positions with respect to the centre plane.

2. Sports shoe according to claim 1, characterized in that the hinging means are elongated bodies designed to be inserted, from outside, into through-openings provided on the rigid insertion plates, each of which is able to assume at least two different positions on the outer surface of the leg-piece and ends of which are engageable in one of the apertures provided on the said part of the shell.

3. Sports shoe according to claim 2, characterized in that the said rigid insertion plates are designed to assume at least two angularly spaced positions on the outer surface of the leg-piece.

4. Sports shoe according to claim 2, characterized in that the said rigid insertion plates are designed to assume at least two linearly spaced positions on the outer surface of the leg-piece.

5. Sports shoe according to claim 4, characterized in that, when the said rigid insertion plates are designed to assume at least two linearly spaced positions along the vertical on the outer surface of the leg-piece, adjustment of "canting" is also possible.

6. Sports shoe according to any one of the preceding claims, characterized in that the said hinging means are screws and in that their end part is designed to engage in threaded openings fixed to the said upwardly extending part of the shell.

7. Sports shoe according to claim 6, characterized in that the said threaded openings are provided on rigid plates fixed to the said upwardly extending part of the shell.

8. Sports shoe according to claim 6, characterized in that the said threaded openings consist of flanged and threaded bushes fixed to the said upwardly projecting part of the shell.

* * * * *